US005740590A

United States Patent [19]

Mohr

[11] Patent Number: 5,740,590

[45] **Date of Patent: *Apr. 21, 1998**

[54] ALIGNMENT DEVICE

[76] Inventor: Donald C. Mohr, HC 67 Box 9, Nogal, N. Mex. 88341

[ * ] Notice: The term of this patent shall not extend beyond the expiration date of Pat. No. 5,592,718.

[21] Appl. No.: 709,637

[22] Filed: Sep. 9, 1996

Related U.S. Application Data

[63] Continuation-in-part of Ser. No. 369,156, Jan. 5, 1995, Pat. No. 5,592,718.

[51] Int. Cl.[6] ..... A44B 11/22

[52] U.S. Cl. ..... 24/265 BC; 24/265 R

[58] Field of Search ..... 24/265 R, 265 BC, 24/265 H, 265 EC, 265 AL, 481, 482

[56] References Cited

U.S. PATENT DOCUMENTS

| | | | |
|---|---|---|---|
| 1,833,175 | 11/1931 | Pollock | 24/265 BC |
| 5,305,540 | 4/1994 | Blenk | 24/265 R X |
| 5,592,718 | 1/1997 | Mohr | 24/265 BC |

FOREIGN PATENT DOCUMENTS

| | | | |
|---|---|---|---|
| 228521 | 11/1910 | Germany | 24/265 BC |
| 2739197 | 3/1979 | Germany | 24/265 R |

*Primary Examiner*—James R. Brittain
*Attorney, Agent, or Firm*—Kevin Lynn Wildenstein

[57] ABSTRACT

An alignment device for centering both ends of a belt relative to a U-shaped mount of a belt buckle. The inventive device includes a foldable web positionable about the U-shaped mount and including upper and lower spacing webs extending between the belt and respectively opposed upper and lower portions of the U-shaped mount to center the belt relative thereto so as to preclude tilting of the belt buckle relative to the belt. The novelty of the present invention also includes a stabilizing web disposed between the upper and lower spacing webs to prevent any movement of the spacing webs relative to each other and further includes a loop web attached at a point on the device between the opposed upper and lower portions of the U-shaped mount, the loop web shaped to receive a second end of a belt to prevent such belt end from drooping or hanging outside of the belt buckle which otherwise results in a messy or unkept appearance, yet allows such belt end to be in substantial parallel alignment with the belt's first end.

9 Claims, 5 Drawing Sheets

PRIOR ART

ALIGNMENT DEVICE

This is a continuation in part of prior application Ser. No. 08/369,156, filed Jan. 5, 1995, now U.S. Pat. No. 5,592,718.

FIELD OF THE INVENTION

An alignment device for centering one end of a belt relative to a U-shaped mount of a belt buckle, and for centering and aligning the opposite end of the belt as it passes behind the belt buckle, thereby resulting in both ends of the belt being centered relative to the buckle and vice-versa. The inventive device includes a folded web positionable about the U-shaped mount and including upper and lower spacing webs extending between the belt and respectively opposed upper and lower portions of the U-shaped mount to center the belt relative thereto so as to preclude tilting of the belt buckle relative to the belt, includes a stabilizing web disposed between the upper and lower spacing webs to prevent any movement of the spacing webs relative to each other, and further includes a loop web disposed on the device adapted to receive the opposite end of a belt as it passes behind the belt buckle to prevent such belt end from hanging outside from behind the belt buckle.

BACKGROUND OF THE INVENTION

The present invention relates to spacing devices and more particularly pertains to an belt buckle alignment device for centering an end of a belt relative to a U-shaped mount of a belt buckle, and for centering and aligning the opposite end of the belt as it passes the belt loop, thereby resulting in both ends of the belt being centered relative to the buckle.

Belt buckles in common usage today form a variety of selections, sizes and weights. More notably, larger style belt buckles, or those characterized as championship belt buckles, are increasingly being worn by the consuming public in corporate offices to rodeo events, both as a fashion statement and as a decorative piece of art. However, with the variety of larger belt buckle selections available to the consuming public, advances in the art of belt design has not followed. Further, the consuming public has determined that the use of larger size and weight belt buckles does not translate into the use of larger size and/or weight belts. As such, when large size and/or weight belt buckles are used with smaller, thinner or belts of less proportional weight than the belt buckle, the belt buckle tends to misalign itself from its relative position to the belt.

The use of spacing devices is known in the prior art. More specifically, spacing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art spacing devices include U.S. Pat. No. 5,285,555; U.S. Pat. No. 5,243,741; U.S. Pat. No. 4,733,440; U.S. Pat. No. 4,593,439; U.S. Pat. No. 3,977,049; and U.S. Design Pat. No. 340,679.

While these devices fulfill their respective, particular objectives and requirements, the aforementioned patents do not disclose a belt buckle alignment device for centering both ends of a belt relative to a belt buckle which includes a folded web positionable about the U-shaped mount of the belt buckle, including upper and lower spacing webs extending between the belt and respectively opposed upper and lower portions of the U-shaped mount to center the belt buckle relative to both ends of the belt, includes a stabilizing web disposed between the upper and lower spacing webs to prevent any movement of the spacing webs relative to each other, and further includes a loop web disposed on the device adapted to receive the opposite end of a belt as it passes behind the belt buckle to prevent such belt end from hanging outside from behind the belt buckle.

In these respects, the belt buckle alignment device according to the present invention substantially departs from the conventional concepts and designs of the prior art, and in so doing provides an apparatus primarily developed for the purpose of centering both ends of a belt relative to a U-shaped mount of a belt buckle and is more notably designed for use with belt buckles of larger size and/or weight that are in common use today.

SUMMARY OF THE INVENTION

In view of the foregoing disadvantages inherent in the known types of spacing devices now present in the prior art, the present invention provides a new belt buckle alignment device construction wherein the same can be utilized for centering both ends of a belt relative to a belt buckle (and vice versa), and in particular belt buckles which are large or qualify as championship buckles such as are common in the industry, to preclude tilting of the buckle relative to the belt. As such, the general purpose of the present invention, which will be described subsequently in greater detail, is to provide a new belt buckle alignment device apparatus and method which has many of the advantages of the spacing devices mentioned heretofore and incorporate additional novel features that result in a belt buckle alignment device which is not anticipated, rendered obvious, suggested, or even implied by any of the prior art spacing devices, either alone or in any combination thereof.

To attain this, the present invention generally comprises an alignment device for centering both ends of a belt relative to a U-shaped mount of a belt buckle. The inventive device includes a foldable web positionable about the U-shaped mount and including upper and lower spacing webs extending between the belt and respectively opposed upper and lower portions of the U-shaped mount to center the belt relative thereto so as to preclude tilting of the belt buckle relative to the belt. The novelty of the present invention also includes a stabilizing web disposed between the upper and lower spacing webs to prevent any movement of the spacing webs relative to each other. As those of skill in the art will also realize, the present invention further includes a web loop attached at a point between the opposed upper and lower portions of the U-shaped mount, the web loop shaped to receive an opposite end of a belt to prevent such belt end from hanging outside of the belt buckle which otherwise results in a messy or unkept appearance.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended thereto.

In this respect, before explaining the preferred embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new belt buckle alignment device apparatus and method which has many of the advantages of the spacing devices mentioned heretofore and additional novel features that result in a belt buckle alignment device which is not anticipated, rendered obvious, suggested, or even implied by any of the prior art spacing devices, either alone or in any combination thereof.

It is another object of the present invention to provide a new belt buckle alignment device which may be easily and efficiently manufactured and marketed.

It is a further object of the present invention to provide a new belt buckle alignment device which is of a durable and reliable construction.

An even further object of the present invention is to provide a new belt buckle alignment device which is susceptible of a low cost of manufacture with regard to both materials and labor, and which accordingly is then susceptible of low prices of sale to the consuming public, thereby making such belt buckle alignment devices economically available to the buying public.

Still yet another object of the present invention is to provide a new belt buckle alignment device which provides in the apparatuses and methods of the prior art some of the advantages thereof, while simultaneously overcoming some of the disadvantages normally associated therewith.

Still another object of the present invention is to provide a new belt buckle alignment device for centering both ends of a belt relative to a U-shaped mount of a belt buckle to preclude tilting of the belt buckle relative to the belt.

Yet another object of the present invention is to provide a new belt buckle alignment device which includes a folded web positionable about the U-shaped mount of the belt buckle and including upper and lower spacing webs extending between the belt and respectively opposed upper and lower portions of the U-shaped mount to center the belt buckle relative thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, references should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
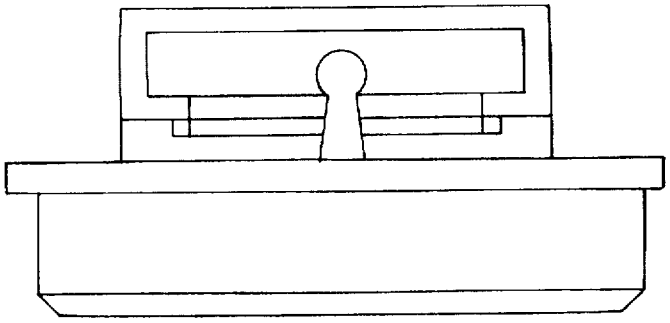
FIG. 1 is an elevation view of a prior art belt buckle.

With reference now to the drawings, and in particular to FIGS. 3–8 thereof, a new belt buckle alignment device embodying the principles and concepts of the present invention and generally designated by the reference numeral 10 will be described.

Figure 2:
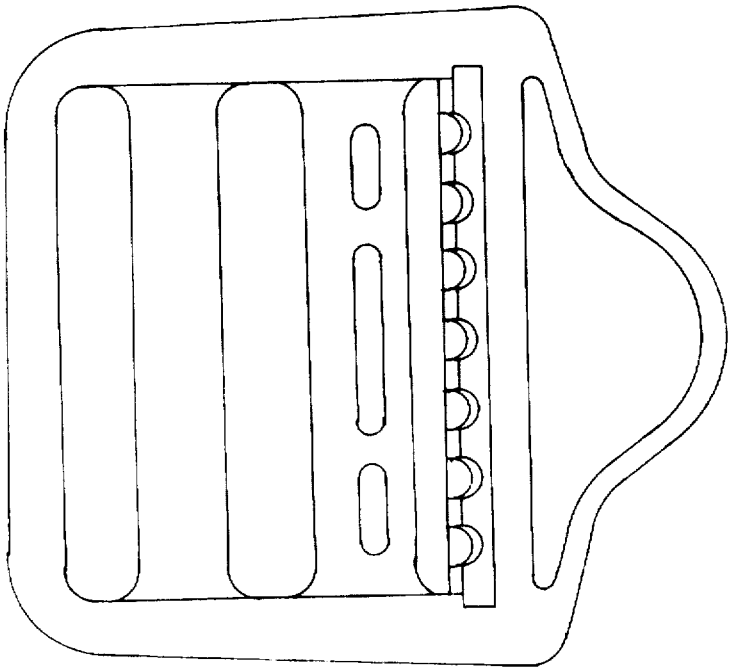
PRIOR ART Fig. 2
FIG. 2 is a plan view of a further prior art belt buckle.
Figure 3:
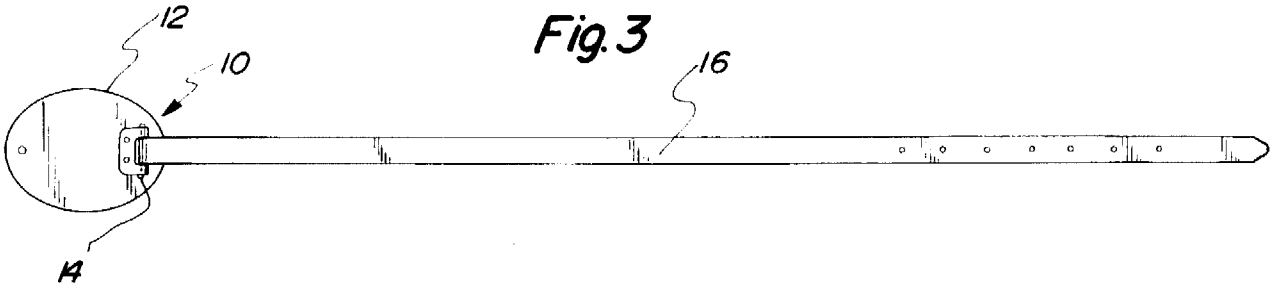
FIG. 3 is an elevation view of a belt buckle alignment device according to the preferred embodiment of the present invention in use.

Turning initially to FIGS. 1 and 2 wherein prior art belt buckles are illustrated, it can be shown that the prior art teaches belt buckles each having a U-shaped mount for receiving and engaging a belt of a particular transverse width.

Figure 4:
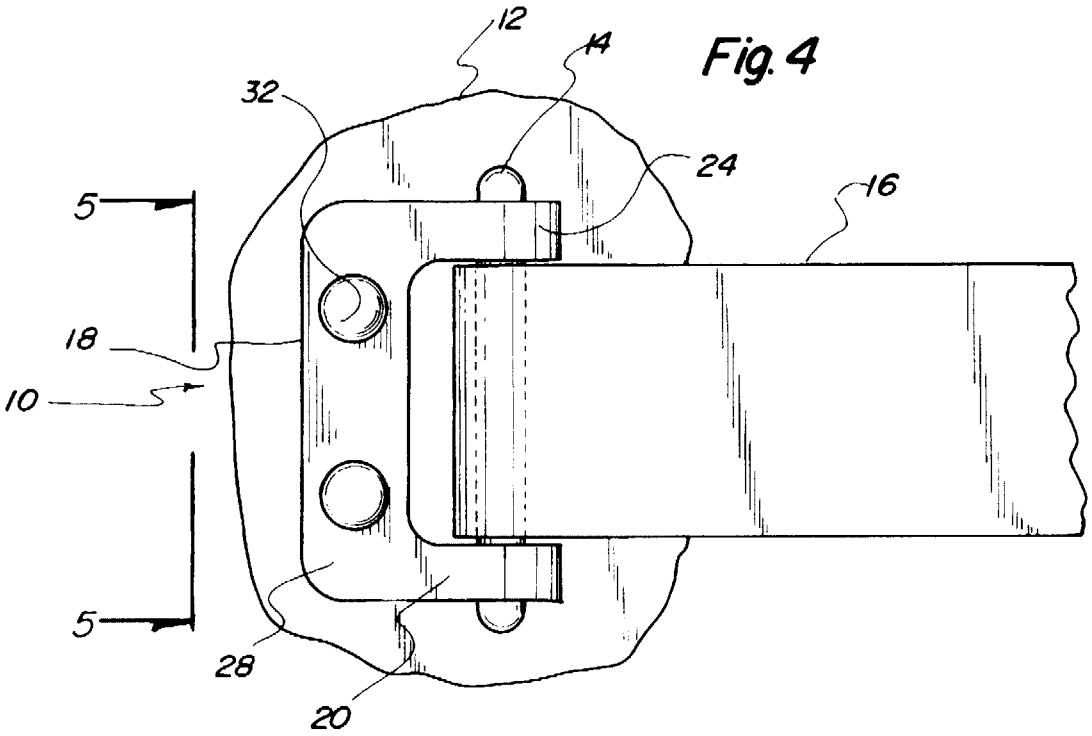
FIG. 4 is an enlarged elevation view of the invention in use.
Figure 5:
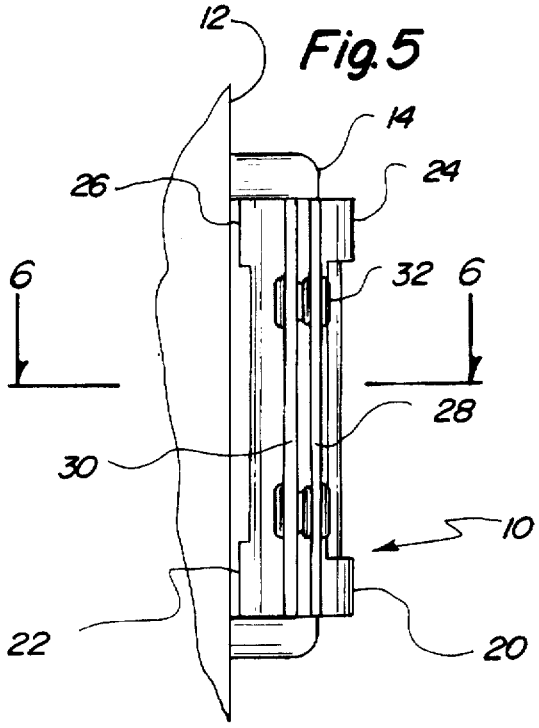
FIG. 5 is an end elevation view taken along line 5—5 of FIG. 4.
Figure 6:
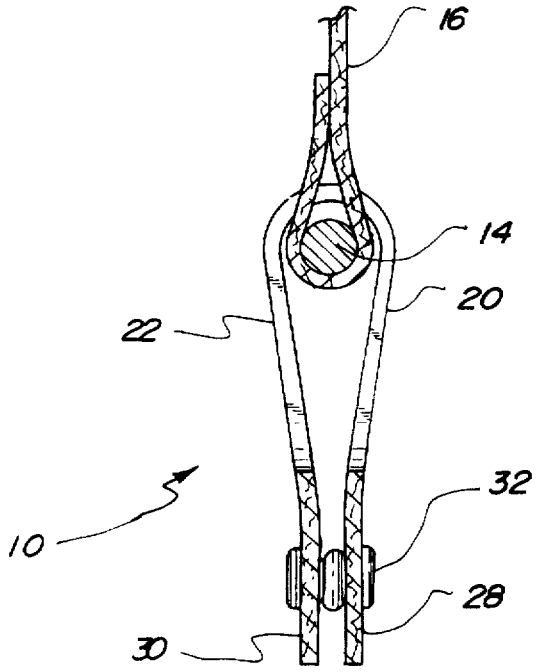
FIG. 6 is a cross-sectional view taken along line 6—6 of FIG. 5.
Figure 7:
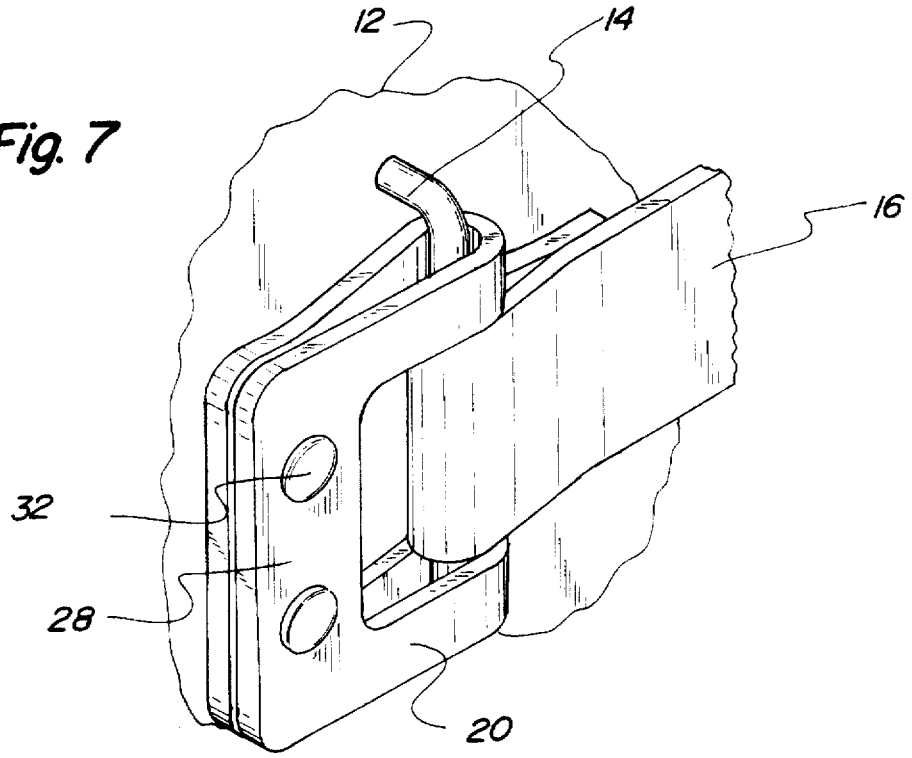
FIG. 7 is an isometric illustration of the belt buckle alignment device as used with a belt buckle having a U-shaped mount.

Turning now to FIGS. 3 through 8 wherein the present invention is illustrated in detail, it can be shown that the belt buckle alignment device 10 is configured for use with a belt buckle 12 having a U-shape mount 14 of a first transverse dimension, with a belt 16 of a second transverse dimension substantially less then the first transverse dimension of the U-shaped mount 14 and coupled to the U-shaped mount substantially as shown. The belt buckle alignment device 10, as shown in FIG. 4 is operable to be engaged to the U-shaped mount 14 to substantially center the belt 16 relative to the mount. To this end, the belt buckle alignment device 10 comprises a folded web 18 including a pair of upper spacing webs and a pair of lower spacing webs which extend between the belt and respectively opposed upper and lower portions of the U-shaped mount 14. Because alignment device 10 can be made from a variety of materials (such as, for example, plastic or resin), its composition is purely a matter of choice, however, the preferred embodiment according to the present invention is leather.

As best illustrated in FIGS. 5 through 8, it can be shown that the folded web 18 is shaped so as to define an outer lower spacing web 20 extendable about a lower portion of the U-shaped mount 14 to define an inner lower spacing web 22. Similarly, an outer upper spacing web 24 extends about an upper portion of the U-shaped mount 14 and continues into an inner upper spacing web 26. The outer lower spacing web 20 is spaced from the oriented so as to extend substantially parallel relative to the outer upper spacing web 24, with an outer securing web 28 extending therebetween. Similarly, the inner lower spacing web 22 spaced from and oriented so as to extend substantially parallel to the inner upper spacing web 26, with an inner securing web 30 extending therebetween. By this structure, the belt 16 can be positioned between the lower spacing webs 20, 22 and the upper spacing webs 24, 26, with the inner securing web 30 being positioned through the U-shaped mount 14 of the belt buckle 12. The outer securing web 28 can then be secured to the inner securing web 30 by at least one securing snap 32. Alternatively, velcro or other similar fastening means can be utilized to removably couple the securing webs 28 and 30 together.

Figure 8:
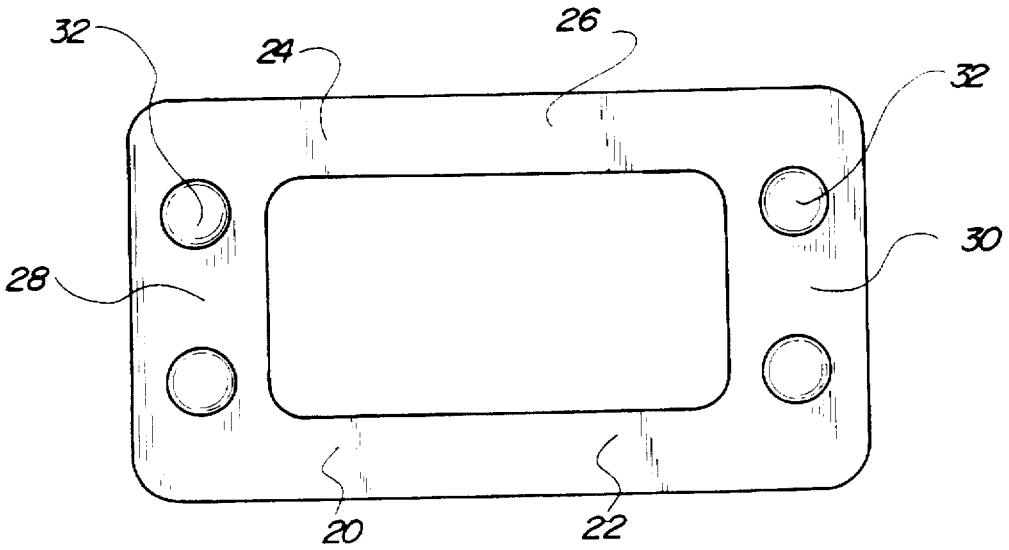
FIG. 8 is a plan view of one embodiment of the present invention in an unfolded condition.

As shown in FIG. 8, the folded web 18 of the present invention 10 can be formed as a substantially rectangular blank having a substantially rectangular aperture extending therethrough so as to define the webs 20–30 thereof.

In use, the belt buckle alignment device 10 according to the present invention can be easily coupled to a belt buckle 12 and belt 16 combination so as to substantially center the belt 16 relative to the U-shaped mount 14 of the belt buckle to preclude tilting of the belt buckle relative to the belt 16.

Figure 9:
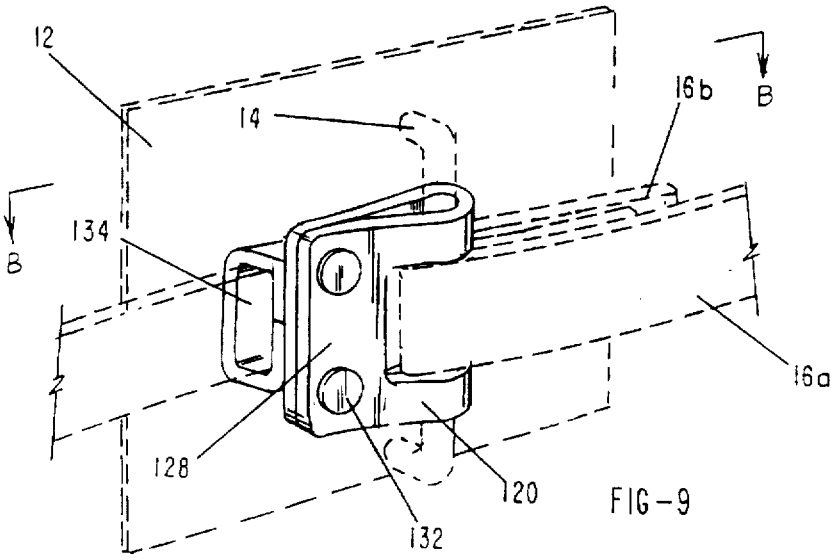
FIG. 9 is an isometric illustration of an alternate embodiment of the present invention as used with a belt buckle having a U-shaped mount.

An alternate embodiment of the present invention is depicted in FIGS. 9–14. As seen in FIG. 9, belt buckle alignment device 100 is configured for use with a belt buckle 12 having a U-shape mount 14 of a first transverse dimension, with a belt 16 of a second transverse dimension substantially less then the first transverse dimension of the U-shaped mount 14, the belt 16 also having a first end **16*a* and a second end 16*b*, the belt being coupled to the U-shaped mount substantially as shown. The belt buckle alignment device 100, as shown in FIG. 9, is operable to be engaged to the U-shaped mount 14 to substantially center the first and second ends (16*a*, 16*b*) of belt 16 relative to the mount. To this end, the belt buckle alignment device 100 comprises a folded web 128 including a pair of upper spacing webs and a pair of lower spacing webs which extend between the belt and respectively opposed upper and lower portions of the U-shaped mount 14**.

As best illustrated in FIGS. 9–12, foldable web 128, when folded, is shaped so as to define an outer lower spacing web 120 extendable about a lower portion of the U-shaped mount 14 to define an inner lower spacing web 122. Similarly, an outer upper spacing web 124 extends about an upper portion of the U-shaped mount 14 and continues into an inner upper spacing web 126. The outer lower spacing web 120 is spaced from the oriented so as to extend substantially parallel relative to the outer upper spacing web 124, with an outer securing web 128 extending therebetween. Similarly, the inner lower spacing web 122 spaced from and oriented so as to extend substantially parallel to the inner upper spacing web 126, with an inner securing web 130 extending therebetween. Substantially between upper spacing webs 124, 126 and inner spacing webs 120 and 122 is attached a stabilizing web 135. By this structure, the belt 16 can be positioned between the lower spacing webs 120, 122 and the upper spacing webs 124, 126, with the inner securing web 130 being positioned through the U-shaped mount 14 of the belt buckle 12. The outer securing web 128 can then be secured to the inner securing web 130 by at least one securing means 132, such as a securing snap device (as shown, for example, in FIG. 9), which is securely attached to outer securing web 128 by any conventional method. Alternatively, velcro or other similar, conventional fastening means can be disposed upon either outer securing web 128 or inner securing web 130 to removably, yet securely, couple the securing webs 128 and 130 together. Stabilizing web 135 prevents any movement between the upper (124, 126) and lower (120, 122) spacing webs relative to each other, and is a novel approach when the present invention must accommodate various sized, shaped and weighted belts.

Figure 13:
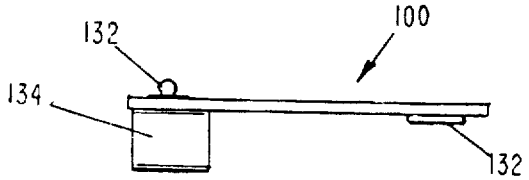
FIG. 13 is cross-sectional view of the embodiment shown in FIG. 12, taken along line a—a.
Figure 14:
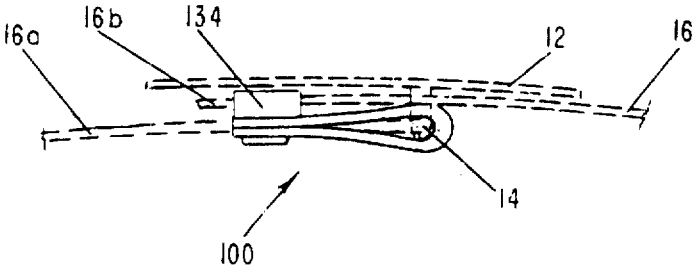
FIG. 14 is a cross-sectional view of the embodiment shown in FIG. 9, taken along line B—B.

It has come to be known that while the present invention solves the problem of belt buckle misalignment, it alternatively could allow a second belt end **16*b* to be in substantial parallel alignment with the belt's first end 16*a*. If the belt's second end 16*b* is not in substantial parallel alignment with the belt's first end 16*a*, belt end 16*b* will tend to droop or result in an unappealing look. As seen in FIGS. 9, and 13–14, the alternate embodiment herein described also includes loop web 134 disposed upon inner securing web 130 to center and align the belt's second end 16*b* as it passes behind the belt buckle 12. While the preferred embodiment describes loop web 134 as oval or circular in nature, those skilled in the art will realize that loop web 134 can be adapted to receive any belt end, and therefore, can take on additional geometric shapes such as a rectangular shape (as seen generally in FIG. 11). Loop web 134 can be attached to the securing webs by any secure, conventional means such as velcro or glue, but for added stability, more secure attaching means, such as rapid rivets or loop staples (shown generally as 136 in FIG. 12), can also be used. With this novel design, both ends of belt 16 are centered relative to the belt buckle, and each end of the belt is in substantial parallel alignment. As those of skill in the art will realize, the placement of loop web 134 on either inner securing web 130 or outer securing web 128 is not critical, as long as its placement allows for receiving a second end (e.g., 16*b***) of a belt to thereby maintain a substantially parallel alignment between the belt's second end and the belt's first end.

Figure 10:
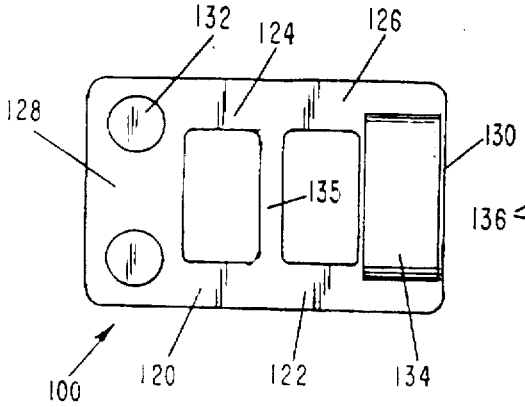
FIG. 10 is a plan view of one side of an alternate embodiment of FIG. 9 in an unfolded condition.
Figure 11:
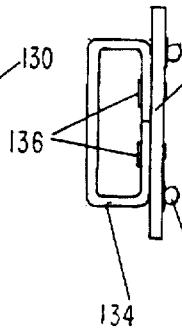
FIG. 11 is right side view of FIG. 10.
Figure 12:
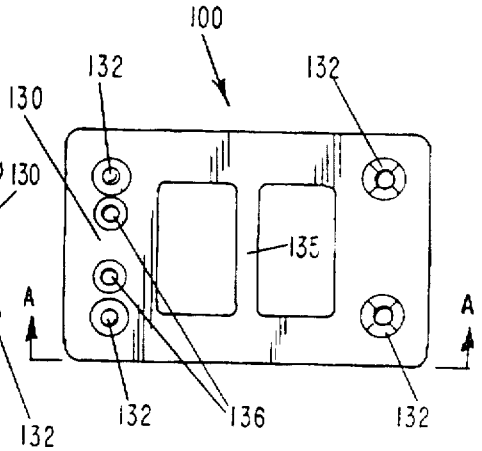
FIG. 12 is a plan view of the opposite side of the embodiment shown in FIG. 10.

As shown in FIGS. 10 and 12, the foldable web 128 of the present invention 100 can be formed as a substantially rectangular blank, with the placement of stabilizing web 135 thereby defining two substantially rectangular apertures extending through foldable web 128, so as to define the webs 120–130 thereof.

In use, the belt buckle alignment device 100 according to the present invention can be easily coupled to a belt buckle 12 and belt 16 combination so as to substantially center the belt 16, or both ends of the belt **16*a* and 16*b*, relative to the U-shaped mount 14 of the belt buckle to preclude tilting of the belt buckle relative to the belt 16**.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Whereas the drawings and accompanying description have shown and described the preferred embodiment of the present invention, it should be apparent to those skilled in the art that various changes may be made in the form of the invention without affecting the scope thereof.

I claim:

1. An alignment device for use with a belt buckle having a U-shaped mount of a first transverse dimension and having opposed upper and lower portions, and for use with a belt of a second transverse dimension substantially less than the first transverse dimension of the U-shaped mount, to substantially center the belt on the U-shaped mount, the alignment device comprising:

(a) a foldable web including a pair of upper spacing webs of a third transverse dimension and a pair of lower spacing webs of a fourth transverse dimension which are extendable between the belt and the respectively opposed upper and lower portions of the U-shaped mount, the sum of the second transverse dimension, the third transverse dimension and the fourth transverse dimension being substantially equal to the first transverse dimension, the foldable web including a stabilizer web disposed substantially between the upper spacing web pairs and the lower spacing web pairs;

(b) securing web portions interposed between the lower spacing webs and the upper spacing webs, and (c) securing means coupled to the securing web portions for joining the securing web portions together about the U-shaped mount, to substantially center the belt relative to the U-shaped mount of the belt buckle.

2. The alignment device of claim 1, wherein the foldable web is shaped so as to define an outer lower spacing web extendable about a lower portion of the U-shaped mount which continues into an inner lower spacing web, and an outer upper spacing web extendable about an upper portion of the U-shaped mount which continues into an inner upper spacing web, the lower spacing webs being spaced from and oriented so as to extend substantially parallel relative to the upper spacing webs, the securing web portions further including an outer securing web extending between the outer lower spacing web and the outer upper spacing web, and an inner securing web extending between the inner lower spacing web and the inner upper spacing web.

3. The alignment device according to claim 2 wherein the third transverse dimension is substantially equal to the fourth transverse dimension.

4. The alignment device according to claim 1 wherein placement of the stabilizing web defines two substantially rectangular apertures extending through the foldable web, the stabilizing web further preventing movement between the upper spacing pairs mad the lower spacing web pairs relative to each other.

5. The alignment device according to claim 4, further including a loop web disposed upon the inner securing web, the loop web adapted to receive a belt's second end to thereby center and align such second end in substantially parallel relationship with a belt's first end.

6. A device adapted to prevent tilting of a belt buckle when attached to a belt having a second transverse dimension, comprising:

(a) the belt buckle, the belt buckle including a U-shaped mount of a first transverse dimension, the U-shaped mount further having an upper portion and an opposed lower portion; and (b) an alignment device, the alignment device comprising a web having a pair of upper spacing webs of a third transverse dimension and a pair of lower spacing webs of a fourth transverse dimension which are extendable between the belt and the respectively opposed upper and lower portions of the U-shaped mount, the upper spacing webs and lower spacing webs foldable upon the opposed upper and lower portions of the U-shaped mount, the sum of the third and fourth transverse dimensions being less than the first transverse dimension by an amount substantially equal to the second transverse dimension, the alignment device further including a loop web disposed upon the inner securing web and adapted to receive a belt's second end.

7. The alignment device of claim 6 further including a stabilizing web attached substantially between the upper spacing webs and the lower spacing webs and adapted to prevent relative movement between the upper spacing webs and the lower spacing webs.

8. An alignment device in combination with a belt buckle having a U-shaped mount of a first transverse dimension and having opposed upper and lower portions, and for use with a belt having a first end and a second end, the belt being of a second transverse dimension substantially less than the first transverse dimension of the U-shaped mount, the alignment device being couplable to the U-shaped mount to substantially center the belt on the U-shaped mount, the alignment device comprising a foldable web including a pair of upper spacing webs of a third transverse dimension and a pair of lower spacing webs of a fourth transverse dimension which are extendable between the belt and the respectively opposed upper and lower portions of the U-shaped mount, the second transverse dimension, the third transverse dimension and the fourth transverse dimension being substantially equal to the first transverse dimension to center the belt relative to the U-shaped mount of the belt buckle, the device further including securing web pairs interposed between the lower spacing webs and the upper spacing webs and further including a stabilizing web attached substantially between the upper spacing webs and the lower spacing webs.

9. The alignment device of claim 8 further including a loop web of predetermined geometric shape, the loop web being securely attached to the foldable web on either of the securing web pairs, the loop web being adapted to receive the belt's second end.

* * * * *